United States Patent [19]

Mikos et al.

[11] 4,155,583

[45] May 22, 1979

[54] VACUUM SUSPENSION FOR HOISTING PLATES

[75] Inventors: Jan Mikos; Jan Kowal, both of Gliwice; Albin Loska, Mikolow, all of Poland

[73] Assignee: Kombinat Budowlany Bytom Zaklad Doswiadczalny "Pras-Bet", Gliwice, Poland

[21] Appl. No.: 841,943

[22] Filed: Oct. 13, 1977

[30] Foreign Application Priority Data

Oct. 16, 1976 [PL] Poland ..... 193089

[51] Int. Cl.[2] ..... B66C 1/02

[52] U.S. Cl. ..... 294/65

[58] Field of Search ..... 294/64 R, 65; 214/8.5 D, 650 SG; 248/362, 363; 269/21

[56] References Cited

U.S. PATENT DOCUMENTS

| | | | |
|---|---|---|---|
| 3,523,707 | 8/1970 | Roth | 294/65 |
| 3,591,228 | 7/1971 | Webb | 294/65 |

FOREIGN PATENT DOCUMENTS

| | | | |
|---|---|---|---|
| 2354898 | 9/1974 | Fed. Rep. of Germany | 294/64 R |
| 1383167 | 11/1964 | France | 294/65 |
| 2265659 | 3/1974 | France | 294/64 R |

*Primary Examiner*—Johnny D. Cherry

*Attorney, Agent, or Firm*—Haseltine, Lake & Waters

[57] ABSTRACT

A vacuum suspension for handling large size plates, especially concrete building parts that are still of low strength and brittle. The suspension is a stiff case forming the carrying structure frame having the vacuum pumps on its top. The inside of the case is divided by a baffle into a work vacuum chamber and decompression chamber. The latter is separated by a holed plate from a foam rubber sheet, having suction cups shaped therein. The holed plate of the suspension has self controlled fluidic disk valves of low inertia.

6 Claims, 2 Drawing Figures

VACUUM SUSPENSION FOR HOISTING PLATES

BACKGROUND OF THE INVENTION

The present invention relates to a vacuum suspension for hoisting plates, especially large size concrete plates which are still not fully hardened and brittle, or other plates exhibiting similar properties.

In known prior art equipment employing vacuum suspension for handling a hoisted body by suction, vacuum pumps create the necessary underpressure. These suspensions are mostly built as structures consisting of tubes simultaneously utilized as a vacuum chamber, and they operate by suction cups which are movably attached or affixed to the carrying structure and connected by flexible pipes to vacuum containing members. However, the suction cups are oriented and controlled by hand. Experiments have been carried out to employ self controlled valves for connecting the suction cups with vacuum chamber. Thus, the known solutions have following disadvantages:

1. The structure form limits the number of suction cups and results in a strong underpressure necessary to obtain adequately high suction forces.

2. High unitary suction forces, spaced widely one from the other on the surface of a hoisted body, may spoil a still not hardened plate during lifting, causing either a three dimensional deformation or direct destruction.

3. When handling different sizes of plates, especially with perforations /e.g. doors, windows etc./, a manual arrangement of suction cups for each plate kind requires additional work and time.

4. When suction cups of constant arrangement operate by ball valves, besides being expensive, the structure is very sensitive to dirt, has comparatively high inertia in time, so they can leak or fail to operate at all.

5. This rather complicated structure requires a strong vacuum and due to low reliability of ball valves leakage occurs and in turn break downs result. The necessary repair work is rather difficult and expensive due to high power pumps kept almost in steady operation.

6. The necessary vacuum for the requisite suction forces depends only on the pump yield, thus being of relatively low dynamic characteristic causing the work reliability to decrease.

SUMMARY OF THE INVENTION

The objective of the present invention is to provide a simple and efficient vacuum suspension structure having high hermetic installation of good reliability, especially of the disengaging valves. A further object of the invention is to provide an apparatus having homogeneous placement of suction forces to handle bodies or plates that are brittle or not adequately hard.

The principal features of the present invention are to overcome a slow dynamic response for vacuum engaged in suction cups of known suspensions by dividing the vacuum chamber in two parts, a larger work chamber forming a vacuum container connected with pumps, and a smaller decompression chamber situated below. Both of the chambers are connected together by electromagnetic valves through a steel baffle to provide a more quick operation.

The decompression chamber is confined at its bottom by a plate with round suction holes, each including a self controlled disk valve made of synthetic resin and in special fluidic design. The bottom of the suspension is formed of a sheet of non-permeable elastic material e.g. foamed rubber, fixed to the holed plate and having the suction cups distributed according to the plate holes.

The described arrangement provides a very dynamic operation, with rapid vacuum and low inertia of disk valves, whereby the influence of dirt does not result in an undisturbed work condition.

IN THE DRAWINGS

PREFERRED EMBODIMENT

Figure 1:
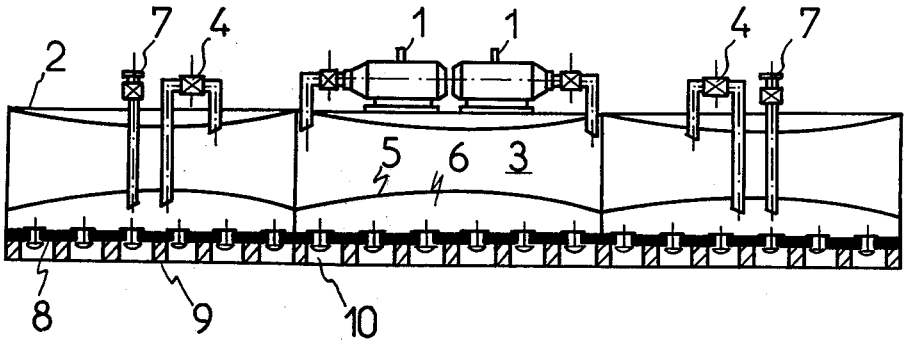
FIG. 1 is a vertical cross section along the vacuum suspension, indicating separate vacuum and decompression chambers.
Figure 2:
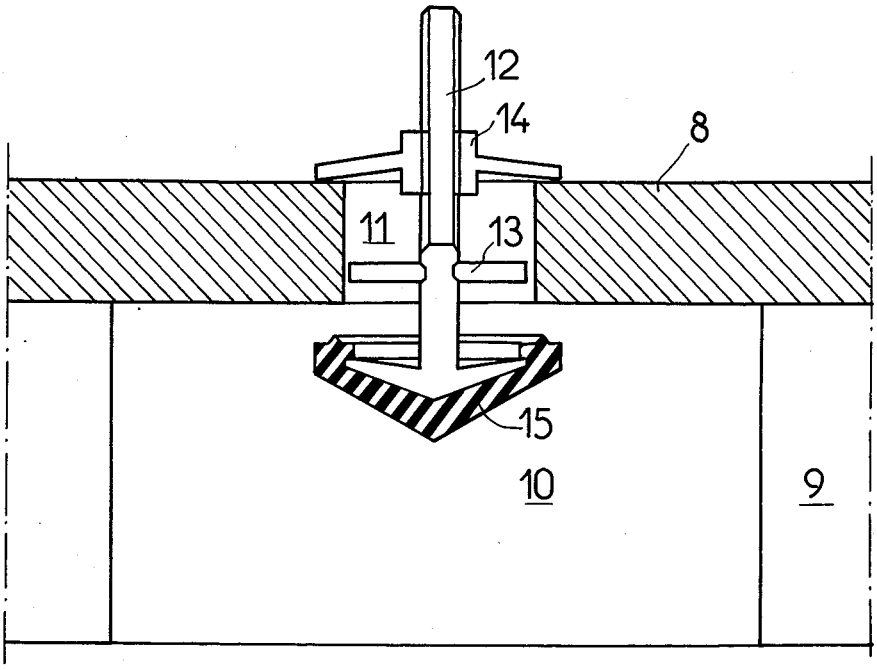
FIG. 2 is a partial vertical section of the bottom plate, showing the suction hole with fluidic self controlled disk valve and the suction cup shaped of foamed rubber.

The embodiment of the invented suspension consists of a stiff case 2 forming a welded carrying structure frame, divided inside into two parts by a preferably convex baffle 5. The upper and larger of these parts forms a vacuum chamber 3, connected to attached vacuum pumps 1 and over the baffle 5 by electromagnet valves 4 to the lower part, thereby forming the decompression chamber 6. The volume ratio of vacuum chamber 3 to decompression chamber 6 has been stated by experiments to be not less than 5. The decompression chamber 6 is connected to ambient atmosphere by air admission valves 7.

The bottom of the decompression chamber is formed of a plate 8, containing the suction holes 11 connecting the decompression chamber 6 to suction cups 10, the plurality of which is formed of non-permeable sheet 9, preferably of foamed rubber, in any desired shape and arrangement. However, tests have indicated that the total volume of suction cups should not exceed the volume of decompression chamber.

Every suction hole of plate 8 contains a self controlled fluidic valve which consists of the stem 12 made of stiff synthetic resin e.g. polypropylene, of the valve stroke limiter 14 and of sealing disk 15. The valve stem has one end threaded to screw the stroke limiter 14 on it, and the other end as a head adapted for the sealing disk 15 while at the middle stem part, there are one or several guiding cross pins 13 of the length a little less than the diameter of the hole 11. The limiter 14 is made of the same material as the stem 12, and the disk 15 of a very elastic resin or rubber. After adjusting the stroke limiters the valves are forcibly placed into the suction holes 11.

According to the invention, the vacuum suspension enables handling of brittle bodies of low strength and of varied shapes and sizes, especially made of concrete, or building elements of other materials; this is due to the dense placement of suction cups and the high dynamic work of the suction. On the other hand, the self controlled fluidic valves of low inertia force, results in small time differentiation of air sucking from the suction cups which are either closed by a lifted body or outside of it, and a hermetically secure condition results. Thus, the suspension work is quite reliable.

The work cycle of the suspension requires only a remote control limited to the following:

engaging the drive of vacuum pumps; steering the hoisting device to set the suspension on the handled body; opening the electromagnetic vacuum valves; carrying the handled body where required; closing the vacuum valves and opening the air admission.

Many modifications and variations of the present invention are possible in light of the above teachings. It is, therefore, to be understood that within the scope of the appended claims, the invention may be practiced otherwise than as particularly described.

We claim:

1. A vacuum suspension apparatus for handling large plates especially of concrete, having a low degree of hardening, employing a vacuum pump assembly disposed on a supporting structure, said supporting structure being closed at the bottom by a perforated plate, said plate being bonded with a flexible layer of plastic material in which suction clamping chambers are formed, wherein: said supporting structure is defined by an interior forming a vacuum chamber, said chamber being divided by a baffle into a first part and a second part, said first part being the larger of said parts and defining a work vacuum chamber and the second of said parts being smaller and defining a decompression chamber; the latter having suction channel means coacting with self operating valve means for connecting the decompression chamber with said suction clamping chambers.

2. A vacuum suspension apparatus for handling plates, as claimed in claim 1, wherein: said decompression chamber has a volume not exceeding 0.2 of the volume of the working vacuum chamber and is approximately equal to the sum of the suction clamping chambers free volume.

3. A vacuum suspension apparatus for handling plates, as claimed in claim 1, wherein: said suction channel means define guideways for said self operating valve means, said valve means is defined by a body portion of plastic material, terminated at one side by a threaded end part and at a second side being formed with a head, guiding bars being portioned intermediate thereof, and an adjustable stroke stop fastened onto said threaded end of said body portion, and a sealing cap formed of plastic pressed tightly upon said head.

4. A vacuum suspension apparatus as claimed in claim 3, wherein: said body portion being formed of polypropylene.

5. A vacuum suspension apparatus as claimed in claim 3, said sealing cap is formed of rubber.

6. A vacuum suspension apparatus as claimed in claim 1, wherein: said layer of plastic material comprises foam rubber.

* * * * *